US009709270B2

(12) United States Patent
Sato et al.

(10) Patent No.: US 9,709,270 B2
(45) Date of Patent: Jul. 18, 2017

(54) FLUIDIZED BED GASIFICATION FURNACE

(75) Inventors: Jun Sato, Tokyo (JP); Toshimasa Shirai, Yokohama (JP); Yoshihisa Saito, Yokohama (JP); Norio Yoshimitsu, Yokohama (JP); Yasunori Terabe, Yokohama (JP)

(73) Assignee: MITSUBISHI HEAVY INDUSTRIES ENVIRONMENTAL & CHEMICAL ENGINEERING CO., LTD., Yokohama-shi (JP)

( * ) Notice: Subject to any disclaimer, the term of this patent is extended or adjusted under 35 U.S.C. 154(b) by 526 days.

(21) Appl. No.: 14/000,651

(22) PCT Filed: Mar. 11, 2011

(86) PCT No.: PCT/JP2011/055766

§ 371 (c)(1),
(2), (4) Date: Aug. 21, 2013

(87) PCT Pub. No.: WO2012/124019

PCT Pub. Date: Sep. 20, 2012

(65) Prior Publication Data

US 2013/0319298 A1 Dec. 5, 2013

(51) Int. Cl.

| | |
|---|---|
| ***F23N 5/18*** | (2006.01) |
| ***F23N 1/02*** | (2006.01) |
| ***F23G 5/30*** | (2006.01) |
| ***F23G 5/50*** | (2006.01) |
| ***F23J 1/02*** | (2006.01) |
| ***F23G 5/027*** | (2006.01) |

(52) U.S. Cl.

CPC ..... *F23N 1/022* (2013.01); *F23G 5/0276* (2013.01); *F23G 5/30* (2013.01); *F23G 5/50* (2013.01); *F23J 1/02* (2013.01); *F23G 2207/1015* (2013.01); *F23J 2900/01009* (2013.01)

(58) Field of Classification Search

CPC ..... F23G 5/00; F23C 11/02

See application file for complete search history.

(56) References Cited

U.S. PATENT DOCUMENTS 3,288,878 A * 11/1966 Hachmuth ..... B01J 8/189 208/164
5,730,072 A * 3/1998 Wright ..... F23G 5/006 110/213
5,735,224 A * 4/1998 Takasuka ..... B09B 3/00 110/165 R

FOREIGN PATENT DOCUMENTS

EP 0041094 A1 12/1981
JP 57-66323 U 4/1982

(Continued)

OTHER PUBLICATIONS

Extended European Search Report dated Feb. 23, 2015, issued in corresponding EP Patent Application No. 11860802.5 (7 pages).

(Continued)

*Primary Examiner* — Jason Lau

(74) *Attorney, Agent, or Firm* — Westerman, Hattori, Daniels & Adrian, LLP

(57) ABSTRACT

A fluidized bed gasification furnace includes a control device that identifies a defective fluidization spot of a fluidized bed based on distribution of temperatures detected by a plurality of temperature sensors, temporarily increases an amount of supplied combustion gas to air boxes located below the identified defective fluidization spot, and increases a speed of discharge of noncombustibles and a fluidization medium discharged by an extruder.

3 Claims, 2 Drawing Sheets

(56) References Cited

FOREIGN PATENT DOCUMENTS

| | | | |
|---|---|---|---|
| JP | 58-9882 | B2 | 2/1983 |
| JP | 58-213107 | A | 12/1983 |
| JP | 59-28172 | Y2 | 8/1984 |
| JP | 60-133206 | A | 7/1985 |
| JP | 7-12721 | U | 3/1995 |
| JP | 7-174471 | A | 7/1995 |
| JP | 3310715 | B2 | 8/2002 |
| JP | 2003-165982 | A | 6/2003 |
| JP | 2003-302040 | A | 10/2003 |
| JP | 2007-271203 | A | 10/2007 |
| JP | 2008-96026 | A | 4/2008 |
| JP | 4295291 | B2 | 7/2009 |

OTHER PUBLICATIONS

International Search Report of PCT/JP2011/055766, date of mailing Apr. 26, 2011.
Written Opinion of PCT/JP2011/055766, date of mailing Apr. 26, 2011.
Decision to Grant dated Apr. 21, 2016, issued in counterpart European application No. 11860802.5. (2 pages).

* cited by examiner

FLUIDIZED BED GASIFICATION FURNACE

TECHNICAL FIELD

The present invention relates to a fluidized bed gasification furnace having a noncombustible discharge device.

BACKGROUND ART

Conventionally, gasification and ash melting systems are known as technologies which can be widely used for treating wastes such as not only municipal wastes, but also noncombustible wastes, burned residues, sludge, buried wastes. Such a gasification and ash melting system includes a gasification furnace which pyrolyzes and gasifies the wastes, a melting furnace that is provided at a downstream side of the gasification furnace, burns a pyrolysis gas generated in the gasification furnace at a high temperature, and converts ash in the gas into a molten slag, and a secondary combustion chamber in which an exhaust gas discharged from the melting furnace is burnt. To convert the wastes into a resource, to melt the wastes less, and to render the wastes harmless, the slag is extracted from the melting furnace and is recycled as construction materials such as a road bed material, or waste heat is recovered from the exhaust gas discharged from the secondary combustion chamber and produces electric power.

In the gasification furnace of this gasification and ash melting system, a fluidized bed gasification furnace is frequently used. The fluidized bed gasification furnace is a device in which a fluidized bed is formed by feeding combustion gas to a bottom of the furnace to fluidize a fluidization medium, which partially burns the wastes charged into the fluidized bed, and pyrolyzes the wastes in the fluidized bed which is maintained at a high temperature by the heat of combustion.

In the fluidized bed gasification furnace, the stabilization of fluidization of the fluidization medium is required. The fluidized bed gasification furnace is disclosed in Patent Literature 1 in which, to stabilize the fluidization of the fluidization medium, a defective fluidization spot is identified based on results detected by a plurality of temperature sensors installed in the furnace, and more combustion gas is fed to the defective fluidization spot.

CITATION LIST

Patent Literature

[Patent Literature 1]
Japanese Patent No. 4295291

SUMMARY OF INVENTION

Problem to be Solved by the Invention

However, the fluidized bed gasification furnace disclosed in Patent Literature 1 has the problem such as that the defective fluidization is not removed if the discharge of noncombustibles is not sufficient even though the defective fluidization spot is identified, and an amount of the combustion gas is increased to stabilize the fluidization.

Taking the abovementioned problem into account, the present invention is directed to provide a fluidized bed gasification furnace which is capable of rapidly discharging noncombustibles out of a system in response to fluidization of a fluidization medium and removing defective fluidization.

Means for Solving the Problem

In order to accomplish the above object, the present invention employs the following means.

A fluidized bed gasification furnace according to the present invention includes a plurality of air boxes installed in parallel, a fluidized bed formed by fluidizing a fluidization medium using combustion gas fed into the furnace via the air boxes, a plurality of temperature sensors which detects temperatures at different positions in the fluidized bed, a noncombustible discharge device that is installed below the fluidized bed and has an extruder that discharges the fluidization medium discharged from the fluidized bed and mixed-in noncombustibles, and a control device that identifies a defective fluidization spot of the fluidized bed based on distribution of the temperatures detected by the plurality of temperature sensors, temporarily increases an amount of supplied combustion gas to the air boxes located below the identified defective fluidization spot, and increases a speed of discharge of the noncombustibles and the fluidization medium discharged by the extruder.

In the fluidized bed gasification furnace according to the present invention, the fluidization of the fluidization medium is activated, and the discharge speed of the noncombustibles is increased. Thereby, the defective fluidization of the fluidization medium can be removed.

Further, in the present embodiment, the plurality of temperature sensors include a first temperature sensor group having a plurality of temperature sensors installed in a depth direction of the fluidized bed, with at least one temperature sensor located in the fluidized bed in the event of startup of the fluidized bed gasification furnace, and a second temperature sensor group having a plurality of temperature sensors installed in an arrangement direction of the air boxes, and the control device identifies the defective fluidization spot based on the temperature distribution in the depth direction which is based on the results detected by the first temperature sensor group and the temperature distribution in the arrangement direction of the air boxes which is based on the results detected by the second temperature sensor group.

According to the present invention, a height of the fluidized bed can be easily obtained by the first temperature sensor group installed in the depth direction of the fluidized bed. Further, the defective fluidization spot can be easily identified by the second temperature sensor group installed in the arrangement direction of the air boxes. As such, the state of the fluidized bed can be obtained through a simple configuration and in real time.

Furthermore, the fluidized bed gasification furnace according to the present invention further includes a pressure detector that detects pressure in each of the plurality of air boxes. The control device temporarily increases the amount of supplied combustion gas to the air boxes, and increase the discharge speed of the extruder, then acquire the pressure in the air boxes from results detected by the pressure detector, and restore the increased amount of supplied combustion gas and the increased discharge speed of the extruder to the original state when the pressures are within a preset normal operation range.

According to the present invention, the amount of supplied combustion gas and the discharge speed of the extruder can be automatically restored to the original state, and excessive discharge of the noncombustibles can be prevented.

Further, the control device according to the present invention controls the discharge speed of the noncombustibles by changing the length of stop time of the extruder while maintaining the length of time for forward and backward movement of the extruder at constant values.

According to the present invention, since there is no need to change a speed of the extruder to move forward and backward, a device that changes the speed is not required, and the extruder can be constructed at a lower cost.

Further, the noncombustible discharge device includes an inclined plane that gradually rises in a forward movement direction of the extruder and a bottom face that supports the fluidization medium and the noncombustibles discharged from the fluidized bed.

According to the present invention, the unintended discharge of the noncombustibles caused by a reduction in the repose angle of the deposited noncombustibles can be prevented.

Furthermore, the fluidized bed gasification furnace according to the present invention further includes a passage between a fluidized bed gasification furnace main body and the noncombustible discharge device, and a cooler that cools the noncombustibles in the passage.

According to the present invention, the noncombustibles are cooled. Thereby, a reduction in a repose angle caused by a high temperature of the noncombustibles can be suppressed, and the repose angle in the noncombustible discharge device can be stabilized.

In addition, the cooler in the present embodiment employs a water-cooled jacket structure which provides indirect water cooling.

According to the present invention, the noncombustibles can be cooled without exerting an influence on a flow of the noncombustibles.

Effects of the Invention

In the fluidized bed gasification furnace according to the present invention, the fluidization of the fluidization medium is activated, and the discharge speed of the noncombustibles is increased. Thereby, the defective fluidization of the fluidization medium can be removed.

DESCRIPTION OF EMBODIMENTS

Hereinafter, an exemplary embodiment of the present invention will be illustratively described in detail with reference to the drawings. Unless otherwise specified, the dimensions, materials, shapes, and relative arrangements of the various components described in the present embodiment are not intended to limit the scope of the present invention thereto but merely for the purpose of description.

Figure 1:
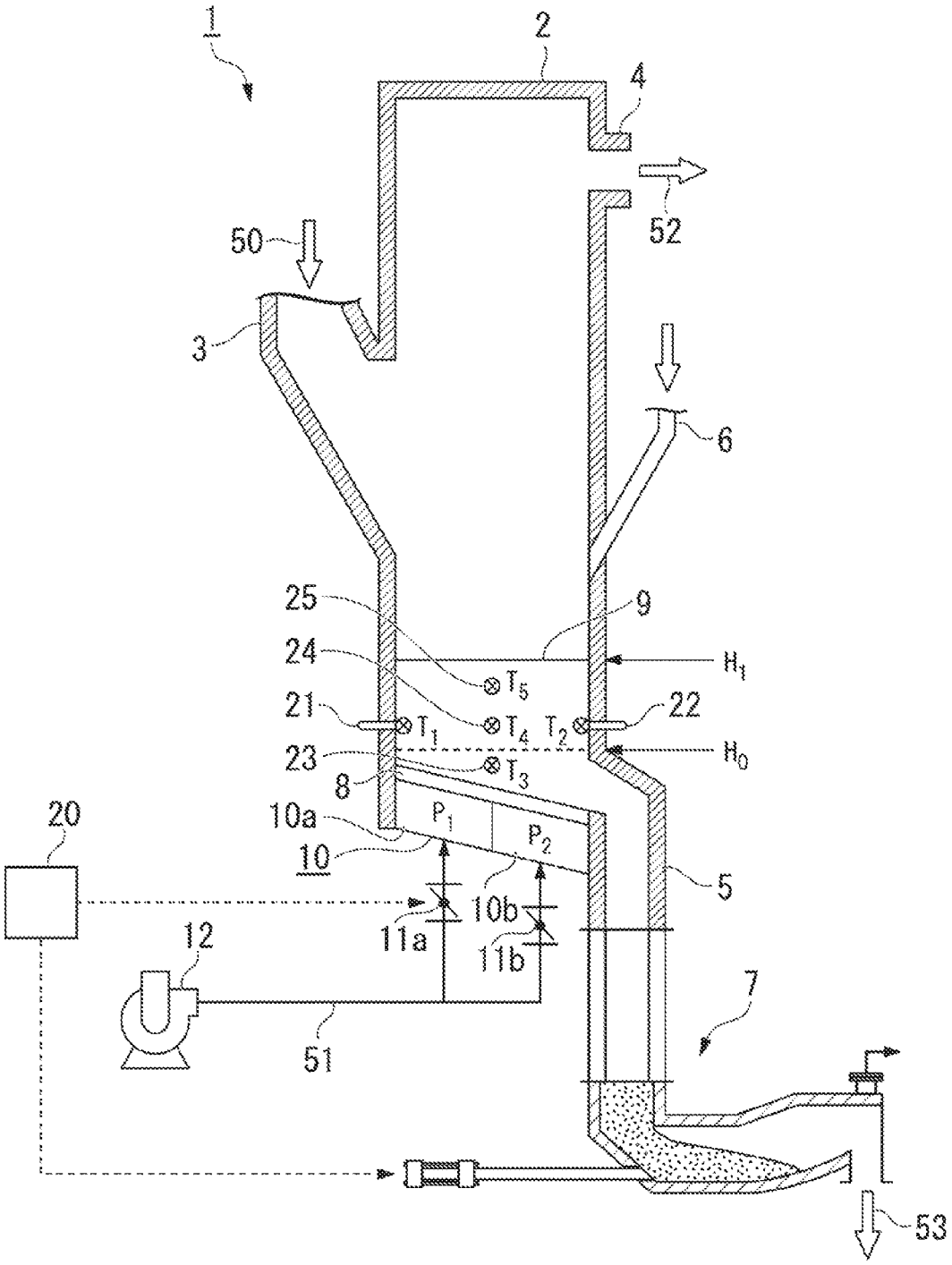
FIG. 1 is a diagram showing a configuration of a fluidized bed gasification furnace according to an embodiment of the present invention.

As shown in FIG. 1, a fluidized bed gasification furnace 1 according to the present embodiment has a gasification furnace main body 2 which is formed in a square tube. The gasification furnace main body 2 is provided with a waste charge port 3 on one sidewall thereof. The gasification furnace main body 2 has a fluidization sand feed port 6 disposed on a sidewall facing the waste charge port 3, a noncombustible discharge port 5 provided below the sidewall, and a noncombustible discharge device 7 connected to the noncombustible discharge port 5.

Further, the fluidized bed gasification furnace 1 according to the present embodiment includes a control device 20 which controls a forced draft fan 12 and a pusher 13 based on an input of a temperature sensor.

A bottom face 8 of the gasification furnace main body 2 is inclined downward from a side of a waste charge port 3 toward a side of a noncombustible discharge port 5 and is provided with a plurality of aeration tubes (not shown).

A plurality of air boxes 10 (10*a* and 10*b*) are provided under the bottom face 8. The plurality of air boxes 10 are provided in parallel in an inclined direction on the bottom face 8. In the present embodiment, a configuration in which two air boxes 10*a* and 10*b* are disposed is described. A combustion gas 51 is supplied to each of the air boxes 10*a* and 10*b* by the forced draft fan 12. The combustion gas 51 is set to a temperature of about 120 to 230° C. and an air ratio of about 0.2 to 0.7. Steam is added to the combustion gas as needed.

Dampers 11*a* and 11*b* are installed on combustion gas channels to the air boxes 10*a* and 10*b*. An opening degree of each of the dampers 11*a* and 11*b* is adjusted so as to control amounts of supplied combustion gas (air volumes) to the air boxes 10*a* and 10*b*. The combustion gas 51 supplied to the air boxes 10*a* and 10*b* is ejected from the aeration tubes of the bottom face 8 into the furnace. The air volumes to the air boxes 10*a* and 10*b* which are set by the dampers 11*a* and 11*b* are defined as $F_1$ and $F_2$.

The air boxes 10*a* and 10*b* are provided with pressure sensors (not shown) which detect pressures in the air boxes. The pressure in the air box 10*a* is defined as $P_1$, and the pressure in the air box 10*b* is defined as $P_2$.

In the gasification furnace main body 2, fluidization sand is fed from the fluidization sand feed port 6 and thereby, a fluidized bed 9 is formed. The fluidization sand is fluidized by the combustion gas 51 supplied from the bottom face 8 via the air boxes 10. During operation, temperature of the fluidized bed 9 is maintained at about 500 to 650° C. Further, a height of the fluidized bed is set depending on a water evaporation load of wastes. The present embodiment includes a case when the combustion gas 51 is not supplied in the event of startup of the fluidized bed gasification furnace 1, in which the fluidized bed 9 is in a repose state. In FIG. 1, the height of the fluidized bed 9 in the event of the startup is indicated by $H_0$, and the height of the fluidized bed 9 during the operation is indicated by $H_1$.

The wastes charged into the fluidized bed gasification furnace 1 are dried and pyrolyzed in the fluidized bed 9. During those treatments, noncombustibles are discharged from the noncombustible discharge port 5 along with the fluidization sand. The wastes are decomposed into gases, tar, and char (carbide) by pyrolysis. The tar is a component that is liquid at a normal temperature, but it is present in the form of a gas in the fluidized bed gasification furnace 1. The char is gradually pulverized in the fluidized bed 9 of the fluidized bed gasification furnace 1 and is introduced into a cyclone melting furnace (not shown) as a pyrolysis gas 52 along with the gas and the tar.

In the event of the startup of the fluidized bed gasification furnace 1, the fluidization sand is fed from the fluidization sand feed port 6 into the furnace in advance and is filled up to at least the bed height $H_0$. Then, the fluidization sand is additionally fed while being heated. Finally, the fluidization sand is fed up to the predetermined bed height $H_1$ in a fluidized state.

During the operation, the fluidized bed 9 is in a fluidized state, and the charged wastes 50 are dried and pyrolyzed in the fluidized bed 9. The bed height of the fluidized bed 9 is obtained based on the pressures $P_1$ and $P_2$ of the air boxes 10. As the operation proceeds, the fluidization sand is discharged together with the noncombustibles or be exhausted to the cyclone melting furnace that is a melting facility mixed together with the pyrolysis gas 52 in some cases. Thereby, the bed height may be lowered in such cases. Accordingly, if pressure values of the air boxes 10 are less than or equal to a predetermined value, the fluidization sand is additionally fed.

Further, the fluidized bed gasification furnace 1 is configured so as to include a first temperature sensor group having a plurality of temperature sensors 23, 24, and 25 installed in a depth direction of the fluidized bed 9, and at least one temperature sensor 23 which is located in the fluidized bed in the event of the startup and detects temperatures at different positions in the fluidized bed, and a second temperature sensor group having a plurality of temperature sensors 21, 24, and 22 installed in an arrangement direction of the air boxes 10. In the present embodiment, thermocouples are used as the temperature sensors. Temperatures detected by the temperature sensors 21 to 25 are expressed as $T_1$ to $T_5$. In the present embodiment, the second temperature sensor group is disposed so that the fluidized bed 9 is divided into three band-shaped regions in the arrangement direction of the air boxes 10 and at least one temperature sensor is present in each of the band-shaped regions.

In the first temperature sensor group, the temperature sensor 23, which is present in the fluidized bed in the event of the startup, mainly detects fluidization onset in the event of the startup. Since the temperature of the fluidized bed is increased after the fluidization onset rather than before the fluidization onset, the fluidization onset can be determined by detecting such a change in temperature.

Further, in the first temperature sensor group including the temperature sensors 23, 24, and 25, the bed height of the fluidized bed 9 and the fluidized state in the depth direction of the fluidized bed 9 are mainly detected. As described above, the bed height of the fluidized bed 9 can be detected according to the pressures in the air boxes as well. However, when defective fluidization such as blockage of the aeration tubes occurs, the bed height cannot be obtained based on the pressures in the air boxes. Therefore, accurate bed height can be obtained by the first temperature sensor group coordinately.

The temperature sensors 21, 24, and 22 included in the second temperature sensor group are installed at approximately the same heights in the depth direction of the fluidized bed 9 and are disposed at predetermined intervals in the arrangement direction of the air boxes 10. Temperature distribution in a horizontal cross section of the fluidized bed 9 is obtained by the second temperature sensor group. Then, this temperature distribution is compared with the temperature distribution during the normal operation, and thereby local defective fluidization can be detected. For example, when a partial low-temperature spot is present in the obtained temperature distribution, the fluidized bed 9 located at such low-temperature spot is identified as defectively fluidized. For example, when the temperature T4 detected by the temperature sensor 24 indicates a lower value than the temperatures T1 and T2 detected by the other temperature sensors, it can be found that the defective fluidization locally occurs in the vicinity of the temperature sensor 24. Further, since the temperature distribution of the depth direction of the fluidized bed is obtained by the first temperature sensor group including the temperature sensors 23, 24, and 25, the defective fluidization in the depth direction can be detected similarly.

Accordingly, since the second temperature sensor group including the temperature sensors 21, 24, and 22 is installed, the defective fluidization spot can be identified easily and in real time.

Next, details of the noncombustible discharge device 7 will be described.

Figure 2:
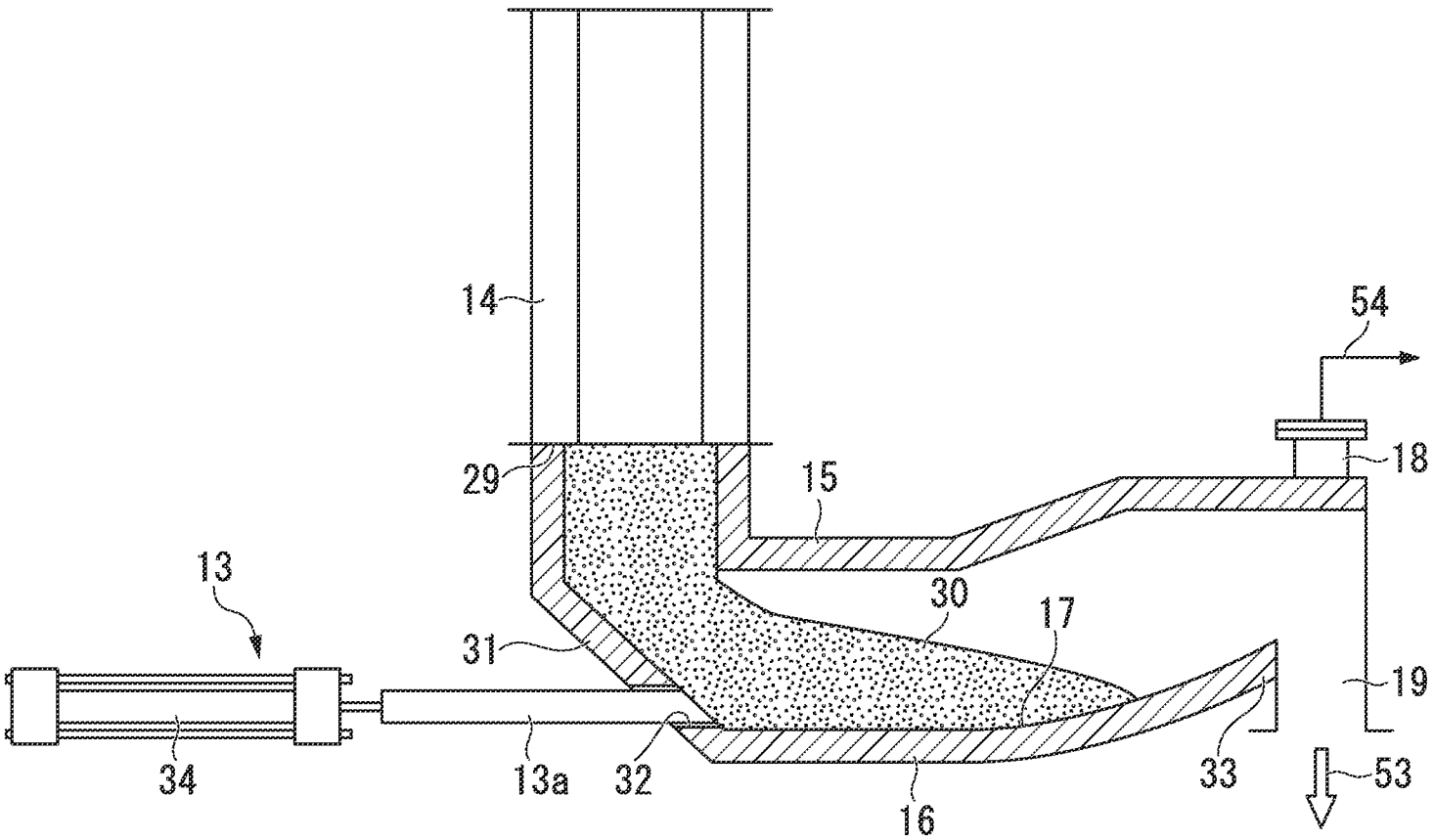
FIG. 2 is a schematic diagram showing a noncombustible discharge device according to the embodiment of the present invention.

The noncombustible discharge device 7 has a noncombustible introduction passage 14 connected to the noncombustible discharge port 5 of the fluidized bed gasification furnace 1, a casing 15 having an inlet 29 connected to the noncombustible introduction passage 14, a pusher 13 pushing out the noncombustibles accumulated on a bottom face 16 of the casing 15, an exhaust gas outlet 18 formed in an upper face of the casing 15, and a noncombustible discharge port 19 from which the noncombustibles are discharged. Hereinafter, in a sliding direction of the pusher 13, a forward movement direction is referred to as forward (rightward in FIG. 2), and a backward movement direction is referred to as rearward. Further, these directions are collectively referred to as a front-back direction.

In the noncombustible introduction passage 14, a wall which forms the passage 14 is a hollow water-cooled jacket structure. Cooling water is introduced into the hollow water-cooled jacket structure.

The casing 15 has the shape of a box that extends in a front-back direction and is formed with an inclined plane 31 for flowing the noncombustibles toward the front on an extension line of the noncombustible introduction passage 14. An insertion hole 32 into which the pusher 13 is inserted is formed in a lower portion of the inclined plane 31. The noncombustible discharge port 19 is formed in a front end of the bottom face 16 of the casing 15 in a downward direction.

The bottom face 16 of the casing 15 is formed with an inclined plane 17 that gradually rises toward the front. The inclined plane 17 is formed in a shape of an arc that is smoothly connected to the bottom face 16 when viewed from the top. In the present embodiment, a radius of the arc is about 1 meter. A front end of the inclined plane 17 forms an outlet 33 of the casing 15, and the noncombustible discharge port 19 is connected to the outlet 33. In the present embodiment, a height of the outlet 33 from the bottom face 16 is about 600 mm.

The pusher 13 is configured of a cuboidal pusher main body 13*a* that widens in a horizontal direction and a hydraulic cylinder 34 that slidably drives the pusher main body 13*a*. The pusher main body 13*a* is slidably driven so as to be movable back and forth by the hydraulic cylinder 34. The pusher 13 reciprocates on the bottom face 16 of the noncombustible discharge device 7 with a predetermined stroke. Speeds of the forward and backward movements of the pusher are constant. After the backward movement, the pusher is set to be at a stop for a predetermined time. In the present embodiment, the forward and backward movements are set to 30 seconds, and the stop time is set to 30 seconds.

An upper space of the casing 15 is connected to a bag filter (not shown) via the exhaust gas outlet 18. The gas in the upper space of the casing 15 is suctioned by an induced draft fan (not shown) of a rear stage of the bag filter. An exhaust gas 54 suctioned from the upper space is discharged into the air after dust is filtered out by the bag filter.

The aforementioned control device 20 is connected to the temperature sensors 21 to 25 and the pressure sensors and receives the temperatures detected by the temperature sensors 21 to 25 and the pressures $P_1$ and $P_2$. Further, the control device 20 is connected to the damper 11*a*, the damper 11*b* and the pusher 13 and is capable of controlling the air volumes $F_1$ and $F_2$ introduced into the air boxes 10*a* and 10*b*, and the movement of the pusher 13. A controlling method based on the control device 20 will be described below.

Next, an operation of the fluidized bed gasification furnace 1 of the present embodiment will be described.

First, the wastes 50 are charged into the fluidized bed gasification furnace 1 and are dispersed in the fluidized bed 9. Next, the fluidization medium and the noncombustibles are discharged from the noncombustible discharge port 5 of the gasification furnace main body 2, and are cooled in the noncombustible introduction passage 14, and then are deposited on the bottom face 16 of the noncombustible discharge device 7. In the noncombustible discharge device 7, the pusher 13 reciprocates to discharge the noncombustibles 30. In the present embodiment, each of the forward movement time and the backward movement time in the reciprocation is set to 30 seconds constantly, and the stop time after the backward movement is 30 seconds.

In this case, the bed height and the fluidized state of the fluidized bed 9 are monitored by the first temperature sensor group including the temperature sensors 23, 24, and 25 installed in the depth direction of the fluidized bed 9. Here, when the defective fluidization of the fluidization medium occurs, the spot of occurrence is identified by the second temperature sensor group including the temperature sensors 21, 24, and 22 installed in the arrangement direction of the air boxes 10.

One of the causes of the defective fluidization is considered to be a loss of the pressure, which is resulted from, for instance, the blockage of the aeration tubes occurs and thus the combustion gas 51 required for fluidization is not fed. Accordingly, if the defective fluidization spot is identified by the second temperature sensors, the air volumes of the air boxes 10 located below the defective fluidization spot are further increased compared to those during the normal operation and advance fluidization actively. In detail, an operation that changes a balance of the air volumes of the dampers 11*a* and 11*b* is performed, and thereby the air volume from the forced draft fan 12 is increased. In this way, the air volume introduced into the defective fluidization spot is increased. Thereby, blocking materials are blown away, and the fluidization is recovered.

Further, another cause of the defective fluidization is considered to be that the noncombustibles 30 are deposited on the bottom face 8 of the gasification furnace main body 2. Accordingly, when the defective fluidization of the fluidization medium occurs, the air volume is increased as described above, and the stop time of the pusher 13 of the noncombustible discharge device 7 is reduced. Thereby, a speed of discharge of the fluidization medium and the noncombustibles 30 is increased, and the noncombustibles 30 deposited on the bottom face 16 of the noncombustible discharge device 7 are rapidly discharged, thereby the defective fluidization is recovered. In the present embodiment, the stop time is set to 5 seconds while it is set to 30 seconds in a steady state, and thereby the rapid discharge of the noncombustibles 30 is accelerated.

It is determined according to the pressure $P_1$ or $P_2$ of the air box 10 whether or not the fluidization is recovered. When the defective fluidization takes place, the pressures in the air boxes 10 located below the defective fluidization spot indicate higher values than in the normal operation. Accordingly, the control device 20 detects the pressures in the air boxes while performing the recovery operation, and determines that the fluidization is recovered if the pressures of the air boxes are reduced. If the fluidization is recovered, the control device 20 controls and recovers the air volumes which are introduced into the air boxes 10 to the values of the normal operation.

Further, if the noncombustibles are at a high temperature, a repose angle of the deposited noncombustibles is reduced, which causes an unintended discharge of the noncombustibles. In the fluidized bed gasification furnace 1 of the present embodiment, since the noncombustibles 30 are cooled in a step prior to the deposition by the water-cooled jacket of the noncombustible introduction passage 14, the repose angle of the deposited noncombustibles 30 is kept stable.

Further, the inclined plane 17 which gradually increases in the forward movement direction of the pusher 13 (direction of the outlet 33 of the casing 15), is formed on the bottom face 16 of the noncombustible discharge device 7. Thereby, the repose angle of the deposited noncombustibles 30 is prevented from being reduced. Further, even when the repose angle is reduced, unintended outflow from the noncombustible discharge device 7 can be intercepted. The repose angle is reduced, for instance, by insufficient cooling or a change in ratio of the noncombustibles and the fluidization medium.

According to the aforementioned embodiment, even when the defective fluidization of the fluidized bed 9 is detected, the air volumes to the air boxes 10 are controlled, and the stop time of the pusher 13 is shortened. Thereby, the defective fluidization can be rapidly removed to stabilize the fluidized state.

Further, the noncombustible introduction passage 14 interposed between the fluidized bed gasification furnace 1 and the noncombustible discharge device 7 is used as the water-cooled jacket structure, and the noncombustibles and the fluidization medium flowing into the noncombustible discharge device 7 are cooled in advance. Thereby, the reduction of the repose angle that occurs when the noncombustibles and the fluidization medium are deposited at a high temperature can be suppressed, and the repose angle in the noncombustible discharge device 7 can be stabilized.

The technical scope of the present invention is not limited to the aforementioned embodiment, but can be modified in various ways without departing from the scope of the present invention. For example, in the present embodiment, it is determined by the pressures of the air boxes 10 whether or not the fluidization is recovered. However, without being limited thereto, the air volumes of the air boxes 10 may be recovered to the values of the normal operation after a predetermined time has elapsed while being increased without detecting the recovery of the fluidization.

Further, the shape of the inclined plane 17 is not limited to the arc shape, but may be a linear inclination shape.

REFERENCE SIGNS LIST

1 fluidized bed gasification furnace
7 noncombustible discharge device
9 fluidized bed
10 air box
13 pusher (extruder)
14 noncombustible introduction passage

16 bottom face
17 inclined plane
20 control device
21 temperature sensor
22 temperature sensor
23 temperature sensor
24 temperature sensor
25 temperature sensor
30 noncombustibles

What is claimed is:

1. A fluidized bed gasification furnace comprising:

a plurality of air boxes installed in parallel;

a fluidized bed formed by fluidizing a fluidization medium using combustion gas fed into the furnace via the air boxes;

a plurality of temperature sensors detecting temperatures at different positions in the fluidized bed;

a noncombustible discharge device that is installed below the fluidized bed and has an extruder that discharges the fluidization medium discharged from the fluidized bed and mixed-in noncombustibles and includes a first inclined plane that gradually rises in a forward movement direction of the extruder and a bottom face that supports the fluidization medium and the noncombustibles discharged from the fluidized bed;

a passage between a fluidized bed gasification furnace main body and the noncombustible discharge device;

a cooler that cools the noncombustibles in the passage and prevents a reduction in a repose angle of the noncombustibles in the bottom face along with the first inclined plane; and a control device that identifies a defective fluidization spot of the fluidized bed based on distribution of the temperatures detected by the plurality of temperature sensors, temporarily increases an amount of supplied combustion gas to the air boxes located below the identified defective fluidization spot, and increases a speed of discharge of the noncombustibles and the fluidization medium discharged by the extruder, wherein:

the plurality of temperature sensors include a first temperature sensor group having a plurality of temperature sensors installed in a depth direction of the fluidized bed, including at least one temperature sensor located in the fluidized bed in the event of startup of the fluidized bed gasification furnace, and a second temperature sensor group having a plurality of temperature sensors installed in an arrangement direction of the air boxes, the control device identifies the defective fluidization spot based on the temperature distribution of the depth direction which is based on results detected by the first temperature sensor group and the temperature distribution of the arrangement direction of the air boxes which is based on results detected by the second temperature sensor group, the control device controls the discharge speed of the noncombustibles by fixing forward and backward movement times of the extruder and changing a stop time of the extruder, the noncombustible discharge device is formed with a second inclined plane for flowing the noncombustibles toward the front on an extension line of the passage, an insertion hole into which the extruder is inserted is formed through a lower portion of the second inclined plane, and the noncombustible discharge device includes the horizontal bottom face so that the extruder can be movable back and forth to slide the horizontal bottom face, and the first inclined plane that is formed in a shape of an arc that is smoothly connected to the horizontal bottom face.

2. The fluidized bed gasification furnace according to claim 1, further comprising: a pressure detector that detects pressure of each of the plurality of air boxes, wherein the control device temporarily increases the amount of supplied combustion gas to the air boxes, increases the discharge speed of the extruder, then acquires the pressures in the air boxes from results detected by the pressure detector, and restores the increased amount of supplied combustion gas and the increased discharge speed of the extruder to an original state when the pressures are within a preset normal operation range.

3. The fluidized bed gasification furnace according to claim 1, wherein the cooler is a water-cooled jacket structure which provides an indirect water cooling.

* * * * *